United States Patent [19]

Streetman et al.

[11] 4,418,176

[45] Nov. 29, 1983

[54] SELF-CRIMPING ACRYLIC FIBER FROM A MELT OF TWO NON-COMPATIBLE POLYMERS

[75] Inventors: William E. Streetman, Gulf Breeze; Shashikumar H. Daftary, Pensacola, both of Fla.

[73] Assignee: American Cyanamid Company, Stamford, Conn.

[21] Appl. No.: 269,076

[22] Filed: Jun. 2, 1981

Related U.S. Application Data

[62] Division of Ser. No. 129,765, Mar. 12, 1980, Pat. No. 4,301,104.

[51] Int. Cl.[3] ..... C08L 23/06; C08L 23/12; C08L 33/20

[52] U.S. Cl. ..... 525/57; 525/54.32; 525/59; 525/199; 525/205; 525/212; 525/213; 525/218; 525/221; 525/222; 525/238; 525/931

[58] Field of Search ..... 525/54.32, 238, 57, 525/59, 931

[56] References Cited

U.S. PATENT DOCUMENTS

| | | | |
|---|---|---|---|
| 3,133,039 | 5/1964 | Davis et al. | 525/238 |
| 3,823,204 | 7/1974 | Okada et al. | 525/238 |
| 3,963,790 | 6/1976 | Couchoud | 525/238 |
| 4,081,498 | 3/1978 | Maranci | 525/238 |
| 4,255,532 | 3/1981 | Daftary | 525/59 |

*Primary Examiner*—Carman J. Seccuro
*Attorney, Agent, or Firm*—Frank M. Van Riet

[57] ABSTRACT

A self-crimping, melt-spun acrylonitrile polymer fiber comprising as the continuous fiber matrix a first polymer comprising from about 80 to about 99 weight percent acrylonitrile and from about 1 to about 20 weight percent of one or more monomers copolymerizable with acrylonitrile and heterogeneously dispersed within said fiber matrix a second polymer incompatible with said first polymer.

4 Claims, No Drawings

SELF-CRIMPING ACRYLIC FIBER FROM A MELT OF TWO NON-COMPATIBLE POLYMERS

This is a division of application Ser. No. 129,765, filed Mar. 12, 1980, now U.S. Pat. No. 4,301,104.

This invention relates to a self-crimping melt-spun acrylonitrile polymer fiber and to a process for preparing such fiber. More particularly, this invention relates to such a fiber comprising as the fiber-forming polymer a heterogeneous blend of a major portion of an acrylonitrile polymer and a minor portion of another polymer which is incompatible with the acrylonitrile polymer and possesses thermal properties which differ from those of the acrylonitrile polymer to an extent which enables a desirable degree of permanent crimp to be obtained in the resulting fiber.

The major portion of textile fibers used in the production of yarns and fabrics are made from synthetic fiber-forming polymers. Certain physical characteristics inherent in natural fibers, such as cotton and wool, are not inherent in these synthetic fibers. For example, fibers of wool in their natural form inherently contain a plurality of crimps consisting of waves with the number of crimps per inch in the individual filaments varying widely depending upon the particular grade of wool selected. It has been determined that these crimps are primarily responsible for the soft hand, high bulk, covering power and excellent textile processing properties of wool. Furthermore, the peculiar elastic qualities of wool are thought to stem from these crimps in that when the wool fibers are stretched, the crimps are subjected to a straightening influence causing internal stresses within the crimps, the net effect of which is to urge the fibers to revert to their original crimped configuration.

Various well-known techniques, primarily physical or mechanical, exist for performing an operation called 'crimping' upon strands of synthetic textile fibers. These include the application of external mechanical forces, usually at elevated temperatures. One such technique is 'gear-crimping' wherein a bundle of synthetic fiber is passed between a pair of co-acting gears in the longitudinal direction to provide sharp bends in the fiber which decrease its length. Another technique is 'stuffer crimping' wherein the fiber strand is forced into a stuffing box or confined chamber which forces the strand to curl and shorten in length. Yet another technique involves 'twist-crimping' wherein the filaments are twisted and untwisted to produce a more or less disturbed helical configuration.

More recently, improved crimping techniques have employed the use of bicomponent fiber spinning wherein two polymers of different thermal or hydrophilic properties are extruded as separate streams through the same spinneret orifice so as to unite the two streams in side-by-side relationship. The composite filament that results is then subjected to the action of boiling water which causs differential shrinkage of the two fiber components. In such cases, the filaments ultimately develop a helical crimp, the crimp due to differential shrinkage developing during drying of the boiled fiber and the crimp due to differential hydrophilicity developing during boiling of the fiber.

The complexity of these various processes and of apparatus necessary for their operation tends to deter commercial utilization thereof. Additionally, the nature of the crimped fiber is such that it unfortunately does not lead to fabrics which have the desirable esthetics associated with fabrics obtained from natural fibers.

Recent developments in the field of acrylonitrile polymer fiber have led to a melt-spinning process in which a homogeneous single phase fusion melt of acrylonitrile polymer and water is extruded through a spinneret orifice directly into a steam-pressurized solidification zone wherein the filamentary extrudate is solidified and stretched for denier reduction and polymer orientation. This melt-spinning process and certain variations thereof have resulted in highly desirable acrylonitrile polymer fiber of textile grade.

Although the melt-spinning of single phase melts of acrylonitrile polymer and water is successful in providing desirable textile fiber, there have as yet been no developments with respect to a self-crimping fiber so produced. Such a development would constitute a significant advance in the art and would greatly extend the utility of the melt-spun acrylonitrile polymer fiber.

In accordance with the present invention, there is provided a self-crimping melt-spun acrylonitrile polymer fiber comprising, as the continuous fiber matrix, a first polymer comprising from about 80 to about 99 weight percent acrylonitrile and from about 1 to about 20 weight percent of one or more monomers copolymerizable with acrylonitrile and, heterogeneously dispersed within said fiber matrix, a second polymer incompatible with said first polymer and having thermal and/or hydrophilic properties which differ from those of said first polymer by an amount sufficient to provide self-crimping properties to said fiber, said first polymer constituting the major weight proportion of said fiber.

In accordance with the present invention, there is further provided a process for producing a self-crimping acrylonitrile polymer fiber which comprises preparing fusion melts of water and (1) a first polymer comprising from about 80 to about 99 weight percent acrylonitrile and about 1 to about 20 weight percent of one or more monomers copolymerizable with acrylonitrile and (2) a second polymer incompatible with said first polymer and having thermal and/or hydrophilic properties which differ from those of said first polymer by an amount sufficient to provide self-crimping properties to said fiber, said first polymer constituting the major weight proportion of polymer and said fusion melts being free of any separate phase of water and/or unmelted polymer, dispersing the second polymer melt heterogeneously within the first polymer melt, extruding said dispersion through a spinneret directly into a steam-pressurized solidification zone maintained under conditions which (a) control the rate of release of water from the nascent extrudate, (b) enable the extrudate to solidify and (c) maintain the the solidified extrudate in the plastic state, and subjecting the plastic extrudate to stretching to provide desirable textile properties thereto.

The fiber of the present invention is comprised of a fiber matrix of a major portion of a first polymer which is an acrylonitrile polymer and a minor portion of a second polymer which is incompatible with the first polymer and has sufficiently different thermal and/or hydrophilic properties from those of said first polymer as to provide self-crimping properties to the resulting fiber. Because the second polymer is incompatible with the first polymer and is heterogeneously dispersed within the fiber matrix, the fiber when subjected to boiling water or other hot-wet processing will develop crimps due to the different thermal and/or hydrophilic properties associated with the polymers constituting the fiber matrix. Thus, as a result of hot-wet processing, the different polymer proportions of the fiber matrix will respond differently causing bending or crimping of the fiber along its longitudinal direction. The extent and nature of the crimping attained will be dependent upon the difference in thermal and/or hydrophilic properties of the two polymers used and their proportions in making up the fiber matrix. It is essential that the second polymer be incompatible with the first polymer as well as differing therefrom in thermal and/or hydrophilic properties in order to provide the self-crimping fiber. Compatible polymers will uniformly blend into the fiber matrix and the resulting blend will respond uniformly to hot-wet processing with the result that no crimps form. Although it is possible to control the positioning of compatible polymers in a fiber matrix by the use of special apparatus such as a bicomponent spinneret or by the use of a static mixture, the crimping of the fiber of the present invention is a result of the incompatibility of the two polymers which provide the separate polymer proportions and processing of the fiber therefore requires no special apparatus.

The fiber of the present invention has a matrix composed of a first polymer which is an acrylonitrile polymer and a second polymer which is incompatible with the first polymer and has different thermal and/or hydrophilic properties from those of the first polymer. A convenient method for providing the different natures to the two polymers is to employ polymers of sufficiently different compositions. Thus, the first polymer is an acrylonitrile polymer comprising from about 80 to about 99 weight percent acrylonitrile and about 1 to 20 weight percent of one or more monomers copolymerizable therewith and the second polymer can be free of acrylonitrile or contain proportions of acrylonitrile outside the range of the first polymer so long as the two polymers are incompatible and the difference in thermal and/or hydrophilic properties is sufficient to provide self-crimping properties. Suitable acrylonitrile polymers satisfying the requirements for the first polymer may be hydrophobic or hydrophilic in nature and are illustrated by copolymerization of acrylonitrile with one or more of the following illustrative monomers.

HYDROPHOBIC MONOMERS

Methyl acrylate; ethyl acrylate; butyl acrylate; methoxymethyl acrylate; beta-chloroethyl acrylate; and the corresponding esters of methacrylic and chloroacrylic acid; vinyl chloride; vinyl fluoride; vinyl bromide; vinylidene chloride; vinylidene bromide; allyl chloride; 1-chloro-1-bromoethylene; methacrylonitrile; methyl vinyl ketone; vinyl formate; vinyl acetate; vinyl propionate; vinyl stearate; vinyl benzoate; N-vinyl phthalimide; N-vinyl succinimide; methylene malonic esters; itaconic esters; N-vinylcarbazole; vinyl furan; alkyl vinyl ethers; diethyl citraconate; diethyl mesaconate; styrene; dibromostyrene; vinyl naphthalene; 2-methyl-1-vinyl imidazole; 4-methyl-1-vinyl imidazole; 5-methyl-1-vinyl imidazole and the like.

HYDROPHILIC MONOMERS

Acrylic acid; methacrylic acid; alpha chloroacrylic acid; itaconic acid; vinyl sulfonic acid; styrene sulfonic acid; methallyl sulfonic acid; p-methoxyallyl benzene sulfonic acid; acrylamidomethylpropane sulfonic acid; ethylene-$\alpha$-$\beta$-dicarboxylic acids and their salts; acrylamide; methacrylamide; dimethylacrylamide; isopropyl acrylamide; allyl alcohol; 2-vinyl pyridine; 4-vinyl pyridine; 2-methyl-5-vinyl pyridine; vinyl pyrrolidone; vinyl piperidone; 1,2-dihydroxypropyl methacrylate; hydropropyl methacrylate methosulfate and the like.

The second polymer may be a polymer free of acrylonitrile such as polypropylene, polyethylene, the various fiber-forming nylons; the various fiber-forming polyesters and the like, or it may be a polymer containing acrylonitrile outside the proportions given for the first polymer provided the polymer is incompatible with the first polymer and has thermal and/or hydrophilic properties sufficiently different from those of the first polymer to provide self-crimping properties in the resulting polymer. Incompatible polymers meeting the requirements of the second polymer include grafts of acrylonitrile on starch; copolymers of less than about 70 weight percent acrylonitrile and more than about 30 weight percent vinyl chloride; those acrylonitrile polymers classified as modacrylics and the like.

As indicated, the first polymer will constitute a major weight proportion of the fiber matrix i.e., over 50 weight percent, and the second polymer will constitute a minor weight portion of the fiber matrix. Preferably the first polymer will constitute from about 70 to 90 weight percent of the fiber matrix and one or more polymers of the second polymer type will constitute the balance of the fiber matrix.

The fiber matrix consists of a continuous structure of the first polymer with the second polymer heterogeneously dispersed throughout this structure. The second polymer will exist as segments of the structure large enough to produce crimps upon hot-wet treatment but not so large as to form discontinuities in the continuous structure of the first polymer. Since the second polymer is incompatible with the first polymer and the first polymer forms a continuous fiber structure, discontinuities in the structure formed by the first polymer result in poor physical properties in the resulting fiber. Thus, the segments formed by the second polymer are smaller than the fiber cross-section in width but may be somewhat longer in length. The size of the segments of the second polymer can be controlled by suitable processing. It is preferred to disperse the second polymer as a limited number of larger segments of the size described above rather than as a greater number of smaller segments in order to obtain the maximum crimping effect. Thus, although it is necessary to employ two incompatible polymers of different hot-wet properties to provide self-crimping fiber, the nature of the distribution of the two polymers in the fiber structure influences the magnitude of the crimping effect.

In order to produce the fiber of the present invention, it is necessary to follow processing steps in the manner next described.

A fusion melt of water and the two polymers is prepared following conventional procedures. The water content necessary to form the melt without a separate water content can readily be determined from a phase diagram. The melt will form at a temperature above the boiling point of water at atmospheric pressure. Therefore, the melt is prepared at a pressure at least equal to autogenous pressure while heating the polymer-water composition. It is generally preferred to use the first polymer in the form of a polymer-water solid containing approximately the right proportion of water to form the fusion melt. Any additional water necessary for the second polymer may be added along with the second polymer and any additional water is preferably added to the first polymer-water composition prior to heating to form the melt. The fusion melt may conveniently be prepared using a screw extruder.

It should be noted that since the second polymer is incompatible with the first polymer, the fusion melt will contain two phases, one phase comprising water and the first polymer and the second phase comprising water and the second polymer. However, there should be no additional phases, such as a free water phase or any unmelted polymer phase. In the respect that the fusion melt contains two polymer-water phases, it differs from the conventional single phase melt, but with respect to the absence of free water or unmelted polymer, it is similar to the conventional melt. When this two-phase polymer-water melt forms, the phase containing the second polymer is heterogeneously dispersed within the first polymer melt for extrusion. Such dispersion can be readily accomplished by an adequate blending of the two phase melt.

After the blended two phase melt is prepared, it is extruded through a spinneret directly into a steam-pressurized solidification zone. The spinneret is equipped with a spinneret plate containing orifices that are designed to provide monocomponent fiber in accordance with conventional procedures. That is to say, the blended polymer-water melt is extruded following the procedure for preparing monocomponent fiber. The extrudate, as it exits from the orifices of the spinneret plate, is in the form of filaments which are in a steam-pressurized environment. Generally, the steam is saturated and at a pressure which provides a temperature which is from about 10° to 40° C. below the minimum melting temperature of the polymer-water composition. By "the minimum melting temperature" is meant that temperature at which polymer melting is first observed when the two polymers and water are gradually heated under at least autogenous pressure to form the melt. Additional heating and a higher temperature may be necessary to complete polymer melting but the minimum melting temperature is, as defined, the temperature at which melting first occurs. Under these conditions of steam pressure, the rate of release of water from the nascent extrudate is controlled and deformation or foaming of the extrudate is minimized. The extrudate solidifies and remains in a plastic state which enables stretching to be accomplished while it remains within the solidification zone.

While the nascent extrudate remains within the steam-pressurized solidification zone it is stretched sufficiently to provide denier reduction and polymer orientation to provide desirable textile fiber properties. Such stretching may be in one or more stretch stages. It is generally preferred to employ two stretch stages, the first to provide attenuation to reduce filament denier and the second to provide improved textile fiber properties. Generally, a total stretch ratio of at least 20 is employed and preferably the stretch ratio will be at least 25, said stretch ratios being relative to the linear velocity of the melt through the spinneret.

After stretching of the nascent extrudate is accomplished, the filamentary extrudate emerges into the atmosphere after which it may be further processed as desired.

A preferred additional processing step is that of drying the stretched extrudate in an oven at a dry-bulb temperature in the range of about 120° to 180° C. and a wet-bulb temperature in the range of about 60° to 100° C. Such processing tends to maximize transparency of the resulting fiber.

A second preferred additional processing step is that of relaxing the dried stretched extrudate in steam under pressure to provide filamentary shrinkage of about 5 to 40%. This processing tends to provide a better balance of physical properties.

The invention is more fully illustrated in the examples which follow wherein all parts and percentages are by weight unless otherwise specified.

In the examples which follow, reference is made to crimp product. These values are determined following conventional test procedures.

If the fiber to be tested has not been subjected to a hot-wet processing step after stretching in conjunction with fiber preparation, it is necessary to perform such a step for the crimps to develop. Generally, relaxing of the stretched fiber in steam under pressure is used to produce the crimp but alternative hot-wet processing, such as boil-off may be employed.

Crimp frequency is defined as the number of distinct crimps appearing in a filament length of one inch based on the average of many replicates.

Crimp product represents the value of crimp frequency multiplied by crimp amplitude and by 100 to express the result in percentage. Crimp amplitude is the average height of a crimp in inches based on measurement of numerous replicates. Since this value has units of inch/crimp, and crimp frequency has units of crimp/inch, the units cancel upon multiplication of the values and conversion to percentage gives a meaningful dimension to this property.

Kinematic molecular weight ($\overline{M}_k$) is obtained from the equation $\mu = 1/A\ \overline{M}_k$ wherein $\mu$ is the average effluent time in seconds of a solution of 1 grams of the polymer in 100 milliliters of 50 weight percent aqueous sodium thiocyanate at 40° C. multiplied by the viscometer factor and A is the solution factor derived from a polymer of known molecular weight.

It should be noted that when a fiber is subjected to high stretch ratios in conjunction with fiber-making and relaxation of such fiber in steam under conditions which give rise to significant fiber shrinkage, some degree of self-crimping properties will inherently develop. This invention provides a greater degree of self-crimping properties than would normally result from such processing.

COMPARATIVE EXAMPLE A

A mixture of 82.0 parts of 90/10 copolymer of acrylonitrile/methyl methacrylate (kinematic molecular weight 43,000) and 18 parts of water is melted at 180° C. and extruded through a spinneret having orifices of 120 micron diameter directly into a solidification zone pressurized with saturated steam at 14 psig and stretched therein to provide a two of filaments of 6 denier size. The stretched tow is relaxed in steam at 120° C. to provide a fiber of 8.5 denier per filament. Physical properties and crimp values are given in the table which follows.

EXAMPLE 1

A mixture of 79.5 parts of a 90/10 copolymer of acrylonitrile/methyl methacrylate (kinematic molecular weight 43,000) and 20.5 parts of a commercially available acrylonitrile-grafted starch are blended in a ribbon blender. The resulting blend is melted at 174° C. and subjected to agitation to provide a heterogeneous dispersion of the acrylonitrile-grafted starch melt in the acrylonitrile polymer melt. This melt dispersion is of two phases, an acrylonitrile-grafted starch/water phase and an acrylonitrile polymer/water phase but is free of a separate water phase or an unmelted polymer phase. The melt dispersion is extruded through a spinneret having orifices of 120 micron diameter directly into a solidification zone pressurized with saturated steam at 14 psig and stretched therein to provide a tow of filaments of 6 denier size. The stretched tow is relaxed in steam at 120° C. to provide a fiber of 8.5 denier per filament. Physical properties and crimp values are given in the table which follows.

EXAMPLE 2

A mixture of 90 parts of a graft polymer of 85.65% acrylonitrile, 12.0% methyl methacrylate, 3.1% polyvinyl alcohol, and 0.25% acrylamidomethylpropane sulfonic acid ($M_k$=40,000) and 10 parts polypropylene is blended with 14.5 parts water in a blender. The resulting blend is melted at 188° C. The melt is agitated to provide a heterogeneous dispersion of the polypropylene/water melt in the acrylonitrile polymer/water melt. No separate phase of water or unmelted polymer is present and the two phase polymer/water melt is extruded through a spinneret having orifices of 85 micron diameter directly into a solidification zone pressurized with saturated steam at 10 psig. The nascent extrudate is stretched in two stages while it remains in the solidification zone. The first stage is conducted at a stretch ratio of 3.1 and the second stage is conducted at a stretch ratio which provides a total stretch ratio of 22.6. The resulting fiber is of 2.0 denier per filament. The fiber is dried for 20 minutes in a free-to-shrink state in an oven maintained at 150° C. dry-bulb and 90° C. wet-bulb. The dried fiber is then relaxed in steam at 8.5 psig for 10 minutes to provide a fiber of 3.1 denier per filament. Physical properties and crimp values are given in the table which follows.

EXAMPLE 3

The same acrylonitrile polymer and polypropylene used in Example 2 are again employed. A mixture of 80 parts of the acrylonitrile polymer, 20 parts of polypropylene and 14.0 parts water is blended in a blender. The resulting mixture is melted at 196° C. This melt is prepared as a heterogeneous dispersion as in Example 2 and extruded through a spinneret having orifices of 100 micron diameter directly into a solidification zone pressurized with saturated steam at 13 psig. Two stages of stretch are conducted on the nascent extrudate while it remains in the solidification zone. The first stage is at a stretch ratio of 5.1 and the second stage is at a stretch ratio sufficient to provide a total stretch ratio of 31.9. The resulting 2.0 denier fiber is dried in an oven maintained at 150° C. dry-bulb and 90° C. wet-bulb for 20 minutes. The dried fiber is relaxed in steam at 9 psig for 10 minutes to provide a fiber of 2.5 denier per filament. Physical properties and crimp values are given in the table which follows.

TABLE

PHYSICAL PROPERTIES AND CRIMP VALUES

| | FIBER OF EXAMPLE NO. | | | |
|---|---|---|---|---|
| | Comparative A | Example 1 | Example 2 | Example 3 |
| CRIMP FREQUENCY (C.P.I. [1]) | | | | |
| Initial | 5.7 | 10.0 | 6.9 | 11.5 |
| After Boil | 5.1 | 10.4 | 6.6 | 14.3 |
| CRIMP PRODUCT (%) | | | | |
| Initial | 5.1 | 12.6 | 8.9 | 11.5 |
| After Boil | 5.3 | 6.6 | 5.5 | 6.5 |
| Straight Properties | | | | |
| Tenacity (grams/denier) | 2.7 | 2.3 | 3.6 | 2.7 |
| Elongation (%) | 26 | 14 | 26.0 | 23.0 |
| Loop Properties | | | | |
| Tenacity (grams/denier) | 1.5 | 1.5 | 1.4 | 1.4 |
| Elongation (%) | 15 | 12 | 10.0 | 10.0 |

Note
[1] : c.p.i. = crimps per inch

EXAMPLES 4–7

Following the procedure of Example 2, additional fiber samples are prepared in accordance with the present invention. Details are given in the following table. In each instance, similar physical properties and self-crimping characteristics are obtained.

| | Example 4 | Example 5 | Example 6 | Example 7 |
|---|---|---|---|---|
| 1st Polymer (I) | | | | |
| Composition | 86.6% AN<br>11.5% MMA<br>1.9% AAm | 88.5% AN<br>8.1% MMA<br>3.4% HPA | 92.6% AN<br>7.4% MA | 89.7% AN<br>10.3% MMA |
| $M_k$ | 40,000 | 42,500 | 41,800 | 40,000 |
| 2nd Polymer (II) | | | 70% AN | 80.8% AN |
| | Ethylene-vinyl acetate copolymer (89/11) | Polymethyl methacrylate | 30% styrene copolymer | 9.2% MMA<br>10.0% VdCl |
| Blend Ratio | 90 parts (I)<br>10 parts (II)<br>14.4 parts $H_2O$ | 90 parts (I)<br>10 parts (II)<br>15.4 parts $H_2O$ | 90 parts (I)<br>10 parts (II)<br>16.5 parts $H_2O$ | 90 parts (I)<br>10 parts (II)<br>15 parts $H_2O$ |

NOTE:
AN = acrylonitrile
MMA = methyl methacrylate
AAm = acrylamide
HPA = hydroxy propyl acrylate
MA = methyl acrylate
VdCl = vinylidene chloride

We claim:

1. A self-crimping, melt-spun acrylonitrile polymer fiber comprising as the continuous fiber matrix a first polymer comprising from about 80 to about 99 weight percent acrylonitrile and from about 1 to about 20 weight percent of one or more monomers copolymerizable with acrylonitrile and heterogeneously dispersed within said fiber matrix a second polymer selected from the group consisting of polyethylene and polypropylene incompatible with said first polymer and having thermal and/or hydrophilic properties which differ from those of said first polymer by an amount sufficient to provide self-crimping properties to said fiber, said first polymer constituting the major weight proportion of said fiber.

2. The fiber of claim 1 wherein said first polymer is a graft of acrylonitrile, methyl methacrylate and acrylamidomethylpropane sulfonic acid on polyvinyl alcohol.

3. The fiber of claim 1 wherein said second polymer is polypropylene.

4. The fiber of claim 2 wherein said second polymer is polypropylene.

* * * * *